US007487808B2

(12) United States Patent
Stoye et al.

(10) Patent No.: US 7,487,808 B2
(45) Date of Patent: Feb. 10, 2009

(54) COUPLING SEAL DOCKING DEVICE COMPRISING TWO OF SAID COUPLING SEALS AND CONTAINER COMPRISING AT LEAST ONE OF SAID COUPLING SEALS

(75) Inventors: Joachim Stoye, Neuenburg-Griβheim (DE); Martin Koch, Neuenburg (DE); Peter Lais, Auggen (DE); Christian Greiner, Lörrach (DE)

(73) Assignee: GEA Niro GmbH, Muellheim (DE)

( * ) Notice: Subject to any disclaimer, the term of this patent is extended or adjusted under 35 U.S.C. 154(b) by 0 days.

(21) Appl. No.: 11/750,213

(22) Filed: May 17, 2007

(65) Prior Publication Data

US 2007/0261761 A1 Nov. 15, 2007

Related U.S. Application Data

(63) Continuation of application No. PCT/DE2005/002065, filed on Nov. 17, 2005.

(30) Foreign Application Priority Data

Nov. 17, 2004 (DE) ..... 20 2004 017 855 U

(51) Int. Cl.
*B65B 1/04* (2006.01)

(52) U.S. Cl. ..... 141/315; 141/302; 141/114; 141/319; 141/383

(58) Field of Classification Search ..... 141/302, 141/114, 319, 383; 24/30.5 R, 30.5 W, 30.5 P, 24/30.5 S, 30.5 L, 542–544, 559, 589.1, 586.1, 24/586.11, 585.11, 581.1, 583.11, 584.1, 24/585.1, 585.12; 383/42, 43, 33
See application file for complete search history.

(56) References Cited

U.S. PATENT DOCUMENTS 255,922 A * 4/1882 Bradford ..... 24/30.5 R
381,265 A * 4/1888 Martens ..... 24/30.5 R (Continued)

FOREIGN PATENT DOCUMENTS

FR 811137 A 4/1937

(Continued)

OTHER PUBLICATIONS

International Search Report for PCT/DE2005/002065, Jan. 31, 2006, 3 pages.

*Primary Examiner*—Khoa D Huynh
(74) *Attorney, Agent, or Firm*—Christensen O'Connor Johnson Kindness PLLC

(57) ABSTRACT

A coupling seal includes a first sealing strip containing first and second bearing elements on opposing ends of a rabbet body and a second sealing strip containing first and second bearing elements on opposing ends of a rabbet body. Interior sides of the rabbet bodies seal against one another, at least in sections, such that the first bearing element of the first sealing strip is arranged adjacent to the second bearing element of the second sealing strip and the second bearing element of the first sealing strip is arranged adjacent to the first bearing element of the second sealing strip. A first flexible element extends between first and second fixing devices of the first sealing strip, and a second flexible element extends between first and second fixing devices of the second sealing strip. The first and second flexible elements, when installed, may have a pre-stress.

37 Claims, 6 Drawing Sheets

U.S. PATENT DOCUMENTS

| | | | | | |
|---|---|---|---|---|---|
| 3,171,184 | A * | 3/1965 | Wilhelm Posse | 24/543 |
| 4,296,529 | A * | 10/1981 | Brown | 24/30.5 P |
| 4,847,956 | A * | 7/1989 | Levine | 24/30.5 R |
| 5,079,806 | A * | 1/1992 | Allen | 24/30.5 R |
| 5,379,489 | A * | 1/1995 | Delk et al. | 24/30.5 R |
| 5,428,871 | A * | 7/1995 | Iosif | 24/30.5 R |
| 5,598,608 | A * | 2/1997 | Naslund | 24/30.5 R |
| 5,713,108 | A * | 2/1998 | Solomon et al. | 24/30.5 R |
| 6,058,572 | A * | 5/2000 | Folkmar | 24/30.5 R |
| 6,163,940 | A * | 12/2000 | VanMaanen | 24/543 |
| 6,722,402 | B2 * | 4/2004 | Ambs et al. | 141/114 |
| 7,062,822 | B2 * | 6/2006 | Folkmar | 24/30.5 R |
| 7,104,293 | B2 | 9/2006 | Lais et al. | |
| 7,131,169 | B2 * | 11/2006 | Folkmar | 24/30.5 R |
| 7,181,806 | B2 * | 2/2007 | Folkmar | 24/30.5 R |
| 2002/0133916 | A1 | 9/2002 | Folkmar | |
| 2003/0009858 | A1 | 1/2003 | Goldberg | |
| 2006/0107502 | A1 * | 5/2006 | Fujii et al. | 24/543 |

FOREIGN PATENT DOCUMENTS

| | | | |
|---|---|---|---|
| WO | 02/074631 | A1 | 9/2002 |
| WO | 2004/103816 | A1 | 12/2004 |

* cited by examiner

COUPLING SEAL DOCKING DEVICE COMPRISING TWO OF SAID COUPLING SEALS AND CONTAINER COMPRISING AT LEAST ONE OF SAID COUPLING SEALS

The present invention relates to a coupling seal and to a docking device containing two inventive coupling seals docked to one another. The invention furthermore relates to a holding apparatus for actuating inventive coupling seals or docking devices. The invention also relates to a container for precise metering of powder or granulate materials and containing at least one inventive coupling seal.

In many areas in particular of the processing industry, high demands are frequently placed on the purity of the starting products, which is why contamination with impurities is to be prevented at every point in the process and not just during production and isolation of the starting products. However, it is frequently not possible to completely prevent contact with the environment, specifically when filling the finished starting products into suitable vessels and when transferring them for the purpose of further processing to create intermediate or final products. This in particular can cause the quality of the products that have been further processed to suffer after their production. In some cases entire product lots must be discarded. On the other hand, in particular in the case of toxic compounds, care must be taken that humans and the environment do not come into contact with these substances, which makes it necessary to perform work very carefully and isolated from the environment. Frequently just working under clean-room conditions is enough to be able to satisfy the requirements for transferring toxic substances into suitable processing vessels. In any case, efforts not to contaminate valuable starting products, and the goal of not contaminating the environment with toxic compounds, are associated with great complexity in terms of equipment and occupational safety, and this necessarily is also felt in the production costs. High demands on contamination-free work are normally imposed e.g. by the foods processing, chemical, and pharmaceutical industries, for instance when products in the form of bulk goods or fluids are to be transferred from a fixed first receptacle to a transportable second receptacle. Since many products are very toxic to the human organism, even in extremely small quantities, and other products react with great sensitivity e.g. to the effects of air, industry developed effective coupling elements and docking devices that facilitate filling or emptying a receptacle in an isolated or at least dust-free condition. For instance, for this purpose receptacles are filled using a double-capping method, which, although it is very efficient, has proved to be cost-intensive due to the technical design and the materials used. In addition, reliability in continuous operations frequently does not meet the desired specifications.

DE 43 29 276 A1 suggests a dust-free connector of transportable bulk goods containers that themselves are already provided with a connecting device. In the docked condition, the outlet of the bulk goods container is admitted from above into an elastic disk and in the closed condition is closed off using a closing cone. The diameter of the outlet funnel for the bulk goods container is larger than that of the hole in the rubber disk. The bottom edge of a closing cone disposed in the outlet funnel cuts off the stream of bulk goods. When using a rubber disk with an intentionally under-dimensioned through-opening as the sealing element, however, the possibility cannot be excluded that, at least with frequent use, damage will occur or the elasticity will deteriorate so that it is no longer assured that the outlet funnel is sealingly isolated from the environment. Moreover, special precautions must be taken in order to be able to use displacement of the closing cone to effect environment-isolating sealing of the bulk goods container. The employment options for the dust-free connector in accordance with DE 43 299 276 A1 are thus strictly limited.

DE 20 217 669 U1 describes a sealed docking device between two largely environmentally isolated receptacles, whereby each receptacle, at least in areas, is largely flexible and can be sealingly connected to a coupling seal. Each of the elastic coupling elements, which are sealingly adjacent to one another, have a slit that can be opened by elastically deforming the coupling element. Because each of the slits of the aligned coupling elements adjacent to one another fits exactly one over the other, the slits are opened and filling material can be transported by exerting pressure on opposing sides of the coupling elements. In this manner in particular handling is to be simplified in terms of docking devices as are known from DE 69 505 581 T2 and production costs are to be reduced. A further development to DE 20 217 669 U! [sic] is described in WO 03/037756. The coupling element disclosed therein can have guide rails attached for instance to its longitudinal sides on a circumferential edge and can be equipped on its opposing narrow sides with fixing elements for mutually fixing the coupling elements forming a docking device. Such coupling elements are suitable for axial coupling to a second coupling seal for the purpose of forming the docking device described in the foregoing.

GB 2 040 862 A discloses a packaging apparatus for vacuum packaging or for packaging while excluding air and moisture. In addition to a suction line for evacuating the receptacle to be filled, retaining and clamping members are also provided with which the opening edge of a flexible receptacle can be held during filling and can also be automatically opened and closed. An integral holding apparatus made of a rubber material can also be used here that is also provided with metallic struts in order to assure reliable opening and closing of the opening edge of the flexible container. The apparatus presented in GB 2 040 862 A is intended to be able to shorten filling cycles, reduce or prevent decontamination of the environment [sic], and minimize the complexity of controls during filling.

In particular during continuous operations or during very strong, prolonged exertion of force, the use of thermoplastic molded parts instead of components made of metal for docking systems for contamination-free transferring of bulk goods can lead to material fatigue. For instance, reduced sealing ability has been observed in the case of thermoplastic components whose flexible properties can be used very advantageously for qualitatively high-value coupling seals and docking systems, prolonged displacement from the normal state following cold forming processes. However, this phenomenon is not normally noticeable during the usual transfer cycles, but rather only upon long opening intervals, and here in particular during the use of small-dimensioned coupling seals and docking systems. In addition, it would be very desirable to be able to use coupling seals, and docking systems formed from these coupling seals, that are made of plastic and that are not burdened by the disadvantages outlined in the foregoing and that in particular, despite being made of plastics, do not exhibit material fatigue when continuously loaded and in particular do not indicate any negative effects during prolonged effects of force. At the same time, there should be an effort to further simplify the handling of these coupling seals and docking systems and to further reduce their production costs.

When filling and/or emptying vessels, especially small-volume vessels, with powder bulk materials, there is frequently the problem of precise metering. In addition, it has been determined that the finer the bulk material is, the more difficult it is to facilitate precisely reproducible metering. For this purpose, EP 527 976 B1 suggests a device for metering small quantities of powder or granular substances that has a supply space, which opens under lateral pressure and which has a variably expanding outlet and a supply space that is larger in diameter and is in the shape a nipple on a baby's bottle, that is provided with a tip that tapers to the outlet, and that is for exerting pressure. In addition, a loosening device that can be placed above the outlet for releasing a dome formation, and an activation apparatus for exerting pressure and for vibrating the loosening device can be used. However, such a metering device does not permit a great deal of clearance for the quantities to be transferred. Also, it does not provide any precautions per se for filling in an environmentally sealed manner.

The underlying object of the invention is attained using a coupling seal for environmentally isolated transferring, filling, and/or emptying of receptacles, including at least a first sealing strip, containing at least one at least partly elastic rabbet body having an interior side, an exterior side, at top side and/or edge and/or a bottom side and/or edge, at least a first bearing element on the first end of the rabbet body, in particular having a rounded, in particular radial, exterior circumference or exterior circumference section and/or at least a first interior space for receiving a joint axis and/or in the form of a first hinge element, and at least a second bearing element on the second end of the rabbet body that opposes the first end, in particular having a rounded, in particular radial, exterior circumference or exterior circumference section and/or at least a second interior space for receiving a hinge axis and/or in the form of a second hinge element; at least a second sealing strip, containing at least one at least partly elastic rabbet body having an interior side, an exterior side, a top side and/or edge and/or a bottom side and/or edge, at least a first bearing element on the first end of the rabbet body, in particular having a rounded, in particular radial, exterior circumference or circumference section and/or at least one interior space for receiving a joint axis and/or in the form of a first hinge element, and at least a second bearing element on the second end of the rabbet body that opposes the first end, in particular having a rounded, in particular radial, exterior circumference or exterior circumference section and/or at least one interior space for receiving a joint axis and/or in the form of a first hinge element;

whereby the interior sides of the rabbet bodies of the first and second sealing strip can be sealingly positioned against one another, at least in sections, whereby the first bearing element of the first sealing strip can be arranged adjacent to the second bearing element of the second sealing strip and the second bearing element of the first sealing strip can be arranged adjacent to the first bearing element of the second sealing strip, in each case with the interior sides of the rabbet bodies of the first and second sealing strip at least partially positioned against one another, forming first and second joint bodies, in particular including common exterior surfaces, ill particular cylinder surface areas; and at least a first flexible and/or extensible element with opposing first and second ends that within these first and second ends extends at least between a first fixing device, in particular on or adjacent to the first end, of the rabbet body of the first sealing strip and a second fixing device, in particular on or adjacent to the second end, of the rabbet body of the first sealing strip, and/or at least a second flexible and/or extensible element with opposing first and second ends that within these first and second ends extends at least between a first fixing device, in particular on or adjacent to the first end, of the rabbet body of the first sealing strip and a second fixing device, in particular on or adjacent to the second end, of the rabbet body of the first sealing strip.

The inventive coupling seal is opened by pressing the first and second joint body together and/or by pulling apart first and second sealing strip. In its normal state, therefore, the coupling seal is generally closed, the interior sides of the sealing strip are positioned against one another. This is the result in particular of the use of at least a first and/or at least a second flexible and/or extensible element. Preferably flexible elements are used. Flexible and also extensible elements are each mechanically linked or connected to the sealing strip such that they act against a lateral displacement thereof from its normal state while exposing a through-opening in the inventive coupling seal. Consequently the flexible and/or extensible elements act in opposition to a displacement, oriented outward by the mutually adjacent rabbets.

A flexible element in the sense of the present invention can be flexed laterally and resiliently using the effects of force. Flexible elements are generally not also simultaneously extensible. Suitable flexible elements that are largely invariant relative to a longitudinal extension are preferred. Particularly preferred are suitable flexible elements with pronounced flexural stiffness, the restorability of which does not lose its original quality, even given frequent, potentially also prolonged, displacement. Suitable flexible elements are preferably available in the form of strips, struts, or bars. These strips, struts, or bars are preferably dimensioned such that their transverse extension is not greater than the transverse extension of the rabbet body. The longitudinal extension of these flexible elements is also preferably not greater than that of the rabbet body.

In one particularly suitable embodiment, the flexible element represents a component, in particular a strut, bar, or strip, made of metal and/or a composite material, in particular a carbon and/or fiberglass composite material.

Suitable composite materials include e.g. fiber, tape, film, and particle composite materials. Fiber composite materials are particularly preferred. Fiberglass composite materials can be produced for instance by means of pressing, winding, or centrifugal methods or by means of manual lamination. The fiber composite materials that are particularly suitable are characterized by elevated tensile strength and compressive strength and are flexible, whereby they also have pronounced restorability.

Extensible element in the context of the present invention represent components that when actuated by force can be reversibly changed in their longitudinal extension. These can be e.g. rubber materials known to one skilled in the art such as rubber bands, strips, or bars. The first and/or second end of the first and/or second extensible element of the first and/or second sealing strip are connected to the first or second fixing device of the first and/or second sealing strip and are preferably already in the normal state of the coupling seal, i.e. under a pre-stress when the coupling seal is closed.

In particularly suitable coupling seals the first and/or second flexible element when installed in the fixing device also has a pre-stress. This pre-stress contributes to or effects the interior sides of the rabbet bodies being pressed against one another, which assures a tight seal. For instance, the flexible element in the normal state is embodied arched or flexed and can only be transitioned to the unflexed state and into the fixing devices with the exertion of force. A permanent pressure is exerted onto the exterior side of the sealing strip in that in this embodiment the fixing devices ensure that the flexible element cannot return to its normal state.

One inventive embodiment provides that the first and/or second fixing device of the first and/or second sealing strip is or are present at or on the exterior side of the rabbet body of the first or second sealing strip. For instance, this can involve fixing devices into which the opposing first and second ends of the flexible elements can be inserted or snapped. The flexible elements, when present with their first and second ends in the fixing devices, are preferably movably borne in the direction of the longitudinal axis of the sealing strip in at least one of these fixing devices and can generally not be removed from these fixing devices unless they are severely flexed. The flexing of the rabbet body when opening the coupling seal is not normally enough for this. The fixing devices consequently have as their main function to prevent opposing ends of the flexible element from being able to be removed from this sealing strip, whether the sealing strip is in the normal state, e.g. under a pre-stress, or whether the sealing strip is in the displaced state.

Consequently preferred embodiments are also distinguished in that the first and/or second end of the first and/or second flexible element can be at least partially movably inserted into the first or second bearing element and/or into the first or second fixing device of the first and/or second sealing strip.

In accordance with one preferred embodiment it is furthermore provided that the first and/or second bearing element of the first and/or second sealing strip includes or include the first or second fixing device of the first or second sealing strip. For instance, it is possible to provide insertion or snap-in options for the first and second ends of the elastic elements in the bearing elements.

The distance between the first and second fixing devices is preferably greater than half the length of the rabbet body. When present in the first and second fixing devices, the flexible or extensible element preferably spans the center area of the rabbet body. Naturally two, three, or more flexible and/or extensible elements can also be present adjacent to one another. Alternatively, it is also possible to arrange flexible and/or extensible elements one after the other. For instance, if the first fixing device is present in the first bearing element, a second fixing device and a third fixing device are attached in approximately the center of the rabbet body and a fourth fixing device is present in the second bearing element. The flexible and/or extensible elements then extend between the aforesaid pairs of fixing devices. Naturally the second and third fixing device can form a uniform component in this case.

In one particularly preferred further development, the inventive coupling seal furthermore has at least a first joint cover that can be arranged, while forming a rotary bearing, at least in part over and/or about a first joint body, in particular mutually adjacent first and second bearing elements of the first or second sealing strip, and/or at least a second joint cover that can be arranged, while forming a rotary bearing, at least in part over and/or about a second joint body, in particular mutually adjacent second and first bearing elements of the first or second sealing strip; and/or at least a first joint axis for being received into the first interior space for rotatable bearing of the first joint body, in particular of the first and second bearing element of the first or second sealing strip, and/or at least a second joint axis for being received into the second interior space for rotatable bearing of the second joint body, in particular of the second and first bearing element of the first and second sealing strip.

In another embodiment it is also inventively provided that the first hinge element of the first sealing strip and the second hinge element of the second sealing strip as first joint body, embody a first hinge, in particular a film hinge, and/or that the second hinge element of the first sealing strip and the first hinge element of the second sealing strip as the second joint body embody a second binge, in particular a film hinge.

Furthermore it can be inventively provided that the first and/or second bearing element of the first and/or second sealing strip resembles or resemble at least in part the shape of a circular ring, in particular represent support arms.

The first and second bearing elements are preferably configured such that they form a joint body that is held via a common axis and/or via a common joint cover such that an guided, hinge-like movement of the rabbet bodies connected to the bearing elements is enabled. A rounded or circular exterior and/or interior surface of the bearing elements in general enables the joint to be guided in a simple manner. Naturally adjacent bearing elements and/or the exterior and/or interior surfaces of the joint bodies can be provided with slip agents and/or lubrication means.

In one inventive embodiment it is provided that the first and/or second bearing element of the first and/or second sealing strip is or can be attached to the exterior side of the first and/or second end of the rabbet body of the first and/or second sealing strip. By attaching the bearing elements on the exterior side of the sealing strip, the greatest possible clearance space is provided for the rabbet body over its entire length. This embodiment includes e.g. both those coupling seals in which the bearing element or elements are integral components of the first and/or second sealing strip and those in which the bearing element or elements represent separate components that are reversibly connectable to the sealing strip or supports or rabbets of the sealing strip. For instance it can be provided that a bearing element can be coupled to the sealing strip via a snap-in connection, a spring/groove connection, or some other reversibly detachable force-fit or form-fit connection. This enables very simple handling of the inventive coupling seals and furthermore permits receptacles to be held closed using sealing strips without there being a need to use additional bearing elements. For this purpose, for instance a separate covering rail can be used that can be pulled over mutually adjacent first and second sealing strips, e.g. using a spring/groove connection. The number of structurally complex and thus cost-intensive bearing elements for filling or transferring can thus be sharply reduced in this manner without having to accept limitations when filling and transferring bulk goods.

It can be inventively provided that the, in particular circular ring-shaped, first and/or second bearing element does not or do not extend to the interior side of the rabbet body of the first or second sealing strip, in particular has or have a center square ranging from 90° to 240°. In that the bearing elements do not completely circumscribe a circular path, but rather leave an opening in the area of the interior side of the rabbet bodies, handling when combining the sealing strips to create coupling seals or docking devices, and in particular attaching bag edges to the sealing strips, is rendered easier.

Another embodiment is distinguished in that the first and/or second joint cover has or have interior dimensions that largely coincide with the exterior dimensions of the adjacent first and/or second bearing elements so that in the case of mutually adjacent interior sides of the rabbet bodies of the first and second sealing strips the first joint cover at least partially includes, at least partly aligned, the first and second bearing element of the first or second sealing strip and the second joint cover at least partially includes, at least partly aligned, the second and first bearing element of the first or second sealing strip, forming a rotary bearing. The forces to be applied for bending the elastic rabbet bodies apart can be exerted into the sealing strips for instance by using a joint cover. This joint cover holds the first and second bearing elements forming the joint body, even when the rabbet bodies are opened and closed in their pre-specified adjacent arrangement.

In another embodiment it is provided that the first and/or second joint cover includes a joint cover lid with a joint axis, in particular in the form of a hollow cylinder segment, which [axis] can be inserted into the first interior space formed from the first and second bearing element of the first and second sealing strip or into the second interior space formed from the second and first bearing element of the first and second sealing strip. In addition to fixing or guiding the bearing elements via a joint cover, in one particularly preferred embodiment a joint or rotary axis can also be inserted into these first and second bearing elements or the first and second interior spaces.

In accordance with another aspect of the invention, it is also possible for the joint cover to include a first and a second joint cover half. The first and/or second joint cover halves can have a retention opening in the rounded exterior surface for receiving a retention pin of a bearing element and/or at least one retention bolt on a lid interior side for receiving in a recess on the bottom side or top side of a bearing element. Furthermore, the first and/or second joint cover can have a pre-specified open section that determines the opening angle of the first and second sealing strip in the area of the first and second joint body. Using the maximum displacement defined by the opening angle in the joint body, the maximum size of the opening in the coupling seal can be determined in a simple manner and thus also a pre-specified bulk goods drop speed can be adjusted.

Preferred coupling seals are furthermore distinguished in that the first end, in particular the interior side, of the rabbet body of the first sealing element and/or the second end, in particular of the interior side, of the rabbet body of the second sealing element projects or project into the first interior space, in particular up to about the center of the interior space, and/or in that the second end, in particular that of the interior side, of the rabbet body of the first sealing strip and the first end, in particular of the interior side, of the rabbet body of the second sealing strip projects into the second interior space, in particular up to about the center of the interior space. It has proved particularly advantageous to allow the rabbet bodies to end in about the center of the first and second interior spaces formed by the first and second bearing elements. For one thing, this minimizes the mechanical stress on the components of the coupling seal. For another thing, the bag edges attached to the rabbet bodies are handled gently and are not distorted when the coupling seal is opened and closed.

It has furthermore proved advantageous when the first bearing element of the first and/or second sealing strip includes at least by section at least one circular ring-shaped body and that the second bearing element of the first and/or second sealing strip includes at least two circular ring-shaped bodies spaced apart from one another, whereby the circular ring-shaped body of the first bearing element can be fitted, in particular in alignment, between two circular ring-shaped bodies of the second bearing element that are spaced apart from one another, forming a first joint body, and/or whereby the circular ring-shaped body of the second bearing element can be fitted, in particular in alignment, between two circular ring-shaped bodies of the first bearing element that are spaced apart, forming a second joint body, in each case forming an interior space for receiving at least one joint axis. When the first and second bearing elements of the first or second sealing strip are embodied such that they can be fitted into one another in alignment, the quality of the guidance and fixing when the coupling seal is opened and closed is further increased. It can furthermore be provided that the first and second bearing elements of the first and second sealing strips form a largely uniform cylindrical or spherical exterior surface, at least in sections.

In accordance with another aspect, preferred coupling seals are distinguished in that the interior side of the rabbet body of the first sealing strip and/or the interior side of the rabbet body of the second sealing strip at least in the normal state is or are arched, in particular in the shape of a segment of a circle. Consequently the interior sides when they are positioned against one another close an opening slit. If an inventive coupling seal is formed from two rabbet bodies that are each arched on their interior sides, this initially leads to the fact that for fixed bearing elements or joint bodies the interior sides of these rabbet bodies, which sides are positioned against one another, form a largely straight sealing line. In such a coupling seal, the arching of the interior sides in the normal state itself provides pre-stress and consequently ensures even more secure sealing. Moreover, the use of rabbet bodies that that are arched on the interior side in an inventive coupling seal leads to the fact that the exterior sides of these rabbet bodies frequently have exterior arching in such a coupling seal. This exterior arching is now suitable for controlling or facilitating the moving apart or opening of the rabbet bodies that are positioned against one another. Consequently it is furthermore provided that for, in particular aligned, positioning of the interior sides of the rabbet bodies of the first and second sealing strips at least one exterior side of one rabbet body has an exterior arching. Particularly suitable are also those coupling seals in which the interior side of at least one rabbet body is profiled. Profiling the interior side of the rabbet bodies can both further improve the tightness of the coupling seals and also significantly reduce the risk of residual contamination, e.g. from residual bulk goods remaining in the area of the coupling seal.

Preferred coupling seals have at least one convex support and/or at least one concave channel on the interior side of the rabbet body of the first and/or second sealing strip, which extends or extend in particular from the first end to the opposing second end of the rabbet body, preferably parallel to the longitudinal axis of the rabbet body. It can be provided that at least one convex support is present in the area of at least one longitudinal edge or is configured as longitudinal edge and/or that at least one, in particular central, concave channel is present between two spaced apart longitudinal edges and/or convex supports. In a longitudinal section the convex support can have a largely circular section, in particular with a maximum convexity in about the center of the rabbet body.

Furthermore it is particularly preferred that at least one interior wall, preferably both interior walls, of the rabbet bodies of the first and second sealing strip has at least one, in particular central, convex support and at least one concave channel between the convex support and the top longitudinal edge and at least one concave channel between the convex support and the bottom longitudinal edge of the interior wall. In this, e.g. the convex support can advance further out of the interior wall, at least in sections, than the bottom and/or top longitudinal edges thereof.

It is furthermore possible to embody in particular only the longitudinal edges and the convex supports on the interior wall of the rabbet body elastically or only those areas that are involved in secure sealing with positioning the interior sides of the rabbet bodies against one another. The flexible containers or hoses are preferably not attached to these elastic areas by means of an adhesive, but rather only in those areas that are not essential for secure sealing of the rabbet bodies. This prevents that the continuous elasticity of the aforesaid areas of the interior wall that are used for secure sealing from being pulled to the point of damage by the adhesive agent.

Consequently one particularly preferred coupling seal has a flexible receptacle or a flexible hose that, in particular along the edge areas or longitudinal edges, can be attached to or is present on the interior side, exterior side, top edge, and/or bottom edge of the rabbet bodies of the first and/or second sealing strip, in particular along the entire length of the rabbet bodies.

One preferred embodiment is also distinguished in that the container or hose covers the entire interior side of the rabbet bodies of the first and/or second sealing strip, in particular the edge of the receptacle or hose approximately corresponds to and/or projects beyond the edge of the interior side of the rabbet bodies of the first and/or second sealing strip.

The receptacle or the hose can be glued or welded on its entire surface or partially to the rabbet body or its interior side. In one preferred embodiment, the hose or the flexible receptacle is already integrated during the injection molding production of the rabbet body or the sealing strip at least on one component of the coupling seal. This means that another work step is omitted and a particularly secure and tight connection occurs. Moreover, the hardening phenomena are circumvented that can occur when using adhesives due to the interaction with e.g. a flexible plastic material of the rabbet body. One further development also provides that the hose or the receptacle are worked into or joined both to the first rabbet body or the first sealing strip and to the second rabbet body or the second sealing strip of a coupling seal when these components are being injection molded, either in one step or in successive process steps.

Furthermore it can be inventively provided that the first and/or the second sealing strip has on the longitudinal-side top and/or bottom side, in particular encompassing the section between the interior side and the exterior side of the rabbet body of the first and/or second sealing strip, at least one coupling apparatus, in particular in the form of a groove and/or spring.

Thus in a suitable manner it is provided that the first and/or second sealing strip or its rabbet body has or have on the longitudinal-side top side a groove or a spring and on the longitudinal-side bottom side a spring or a groove.

It has proved advantageous to provide coupling apparatus on the top and bottom sides of the inventive coupling seals since this leads to docking devices, formed from two coupling seals, that are distinguished by a particularly pronounced environmental tightness. Naturally an inventive docking device with which bulk goods can be filled in an environmentally sealed manner can also be obtained just with two inventive coupling seals that can be placed against one another in alignment, especially when the edge of the receptacle or hose approximately corresponds to and/or projects beyond the edge of the interior side of the rabbet bodies of the first and/or second sealing strip.

In accordance with another embodiment it is provided that the first and the second sealing strip [sic] largely coincide in terms of their shape and/or size. One particular advantage of the inventive coupling seals is comprised in that they can be formed from two largely identical sealing strips. For this, it is just necessary to rotate one of the sealing strips 180° C. [sic] in order to be able to be positioned against another sealing strip, forming a coupling seal. This reduces production costs, simplifies assembly, and finally also [leads] to lower non-production time when filling and transferring bulk goods.

In another preferred embodiment it is provided that the rabbet body of the first and/or second sealing strip has at least one elastomer or thermoplastic/elastomer segment at or on the interior side, especially extending across the entire length of the interior side. Consequently the interior side of the rabbet body can be formed by an elastomer segment. The rabbet body or the sealing strip can be made of two or more different materials, whereby the interior side of the rabbet body, in order to obtain a tighter seal, preferably includes the aforesaid elastomer or thermoplastic/elastomer material, while the exterior side can be made e.g. of a thermoplastic material or even metal. Such components can be produced e.g. in a single method step using dual-component injection molding. Consequently the exterior sides of the rabbet body of the first and/or second sealing strip are formed preferably at least in areas from a thermoplastic material, e.g. in the form of a thermoplastic segment. The thermoplastic exterior side or the exterior segment of the sealing strip can also be kept very thin, e.g. in the range of 0.5 to 2 mm. Although the elastomer interior side or the interior segment can also be embodied very thin, as a rule it is on average thicker than the exterior component.

In another, alternative embodiment, the elastomer interior side or the elastomer interior segment of the rabbet body of at least one sealing strip of the coupling seal, at least in areas, especially in its entirety, is dimensioned larger than the exterior side of the rabbet body made e.g. of thermoplastic material. It is particularly advantageous when the elastomer segment of the rabbet body on the opposing longitudinal sides projects beyond the edge of the exterior side material, in particular thermoplastic material, of the rabbet body. The amount of sealing tightness, especially for frequently reversible actuation, is further increased in this manner.

In another, preferred embodiment, the entire rabbet body uses an elastomer material. In this case, only the flexible element determines the restoring ability of the inventive coupling seal. It can be provided e.g. that the elastomer rabbet body has opposing, thermoplastic bearing elements and where necessary fixing devices for the flexible element if these are not present in the bearing elements. Such a component can be obtained e.g. by means of dual-component injection molding. However, in general it has proved practical to fashion the exterior side of the rabbet body, that is its exterior segment, from a thermoplastic material that itself has a certain flexural stiffness. Then preferably the opposing bearing elements and where necessary holding devices are attached to this exterior segment or produced integrally with the exterior segment.

Naturally the flexible element and also the extensible element can be attached not just to the exterior side of the rabbet body. On the contrary, it can also be provided to integrate these elements in the rabbet body in a suitable manner. Such a rabbet body could form e.g. a multilayer structure, including for instance an elastomer interior segment, at least one flexible element, and then a thermoplastic or metal exterior segment.

In accordance with another aspect, particularly preferred coupling seals are distinguished in that the bearing elements and/or exterior sides of the rabbet bodies of the first or second sealing strip contain, at least in sections, in particular along the rounded exterior surfaces, thermoplastic polymers, in particular polyoxyalkylene, preferably polyoxymethylene (POM), polyolefines, e.g. polyethylene and polypropylene, polystyrene, styrene copolymers, e.g. ABS, SAN, ASA, and AES, polyamides, polyester, e.g. polybutylene terephthalate and polyethylene terephthalate, poly(meth)acrylates, e.g. polymethylmethacrylate, PVC, and/or polyketones, preferably alternating carbon monoxide/ethylene copolymers. In particular polyoxyalkylenes such as polyoxymethylenes (POM) and aliphatic, alternating polyketones are distinguished by low wear and very good sliding properties.

In accordance with the invention, coupling seals can moreover have at least one separate and/or integrated retention unit for, in particular temporarily, fixing the position of the first and/or second sealing strip or its rabbet bodies and/or at least one separate or integrated cover unit for at least partial, in particular environmentally sealed, covering of at least one side or surface of the coupling seal provided for docking. Naturally retention unit and docking unit can also be embodied in one component. Suitable retention and/or docking units can furthermore be configured as a transport aid, e.g. as a transport clip, and can ensure that transport or storage of e.g. receptacles and sacks will not be problematic without there being any worry that the contents will contaminate the environment during transport or storage. Thus, with the retention and cover units suitable means are available for securing a coupling seal prior to and after use against unintentional opening or closing and for protecting the docking surfaces against contamination. On their exterior sides, the sealing strips or rabbet bodies usefully have at least one locking element, e.g. a locking groove, into which the retention and cover units can be inserted using appropriate devices, e.g. rails.

The underlying object of the invention with regard to a coupling seal is also attained by such a coupling seal for environmentally isolated transferring, filling, and/or emptying of receptacles, including at least a first sealing strip, containing at least one at least partly elastic rabbet body having an interior side and an exterior side; at least a second sealing strip, containing at least one at least partly elastic rabbet body having an interior side and an exterior side, whereby the interior sides of the rabbet bodies of the first and second sealing strip can be sealingly positioned against one another, at least in sections, and can be reversibly opened given actuation by force, forming a through-opening; and at least a first flexible and/or extensible element that can be positioned or is positioned against the exterior side of the rabbet body of the first sealing strip or can be connected or is connected to the rabbet body of the first sealing strip, and/or at least a second flexible and/or extensible elastic element that can be positioned or is positioned against the exterior side of the rabbet body of the second sealing strip or that can be connected to or is connected to the rabbet body of the second sealing strip.

The underlying object of the invention with regard to a metering apparatus or a metering receptacle is furthermore attained by a container, in particular a precise metering container, for bulk goods, including one at least partly flexible container body and at least one at least partly flexible transport means connected to this container body and containing at least a first opening end, whereby bulk goods can be transferred via the container body into the transport means in the direction of the first opening end, and at least a first and at least a second inventive coupling seal, whereby the first opening end of the transport means is connected or can be connected to the first coupling seal, in particular environmentally sealed, and whereby the interior sides of the rabbet bodies of the first and second sealing strip of the second coupling seal is positioned or can be positioned against the transport means and/or is connected or can be connected to the transport means such that a reversibly sealable passage for bulk materials from the container body via the second coupling seal to the transport means in the direction of its first opening end can be provided.

One preferred embodiment provides a container having an at least partly flexible container body, containing at least a first outlet, at least one at least partly flexible transport means, containing at least a first and at least a second opening end, and at least a first and at least a second inventive coupling seal, whereby the first outlet of the container body is connected or can be connected, in particular environmentally sealed, to the second coupling seal and whereby the second opening end of the transport means is connected or can be connected to the second coupling seal such that a reversibly sealable passage from the container body via the second coupling seal to the transport means can be provided, and whereby the first opening end of the transport means is connected or can be connected to the first coupling seal, in particular environmentally scaled.

With the inventive metering apparatus in particular small vessels, e.g. for quantities ranging from 200 to 1000 g, can also be filled reproducibly precisely and absolutely environmentally sealed, and specifically regardless of the particle size of the bulk goods.

Basically any type of container can be used. Suitable containers should be flexible at least in the area of the transition to the transport means, i.e. at the location at which the second inventive coupling seal is present, such that by actuating the coupling seal a through-opening can be reversibly provided for bulk goods to pass through. Normally flexible plastic containers or bags are used for this. In the case of these containers, the container body is generally larger or has a larger diameter than the transport means. However, this is not an essential requirement. On the contrary, the container body can also have largely the same diameter or the same size or dimensioning as the transport means. In the context of the present invention, for the purpose of easier depiction of the inventive container, a terminological distinction is made between a unit that is present or attached on this side of the second coupling seal, the container body, and a unit that is attached on the other side of the second coupling seal, the transport means. A suitable transport means is for instance a hose or even a tube that is flexible at its opposing end segments. The transport means can taper for instance from the second coupling seal to its first opening end, but can also have a constant diameter. In the context of the present invention, a first outlet of the container body is understood to be that area of the container that extends from the second coupling seal in the direction of the container body. As a rule the container body tapers in this area in the direction of the transport means or of the second coupling seal.

In accordance with an alternative embodiment, the container body can also have at least a first inlet. A first inlet in the context of the present invention represents an opening via which the container can be continuously or non-continuously filled. Naturally such a first inlet can also be connected to an inventive coupling seal so that it is possible to dock to a corresponding inventive coupling seal, forming an inventive docking device.

In accordance with one preferred embodiment, the container body and the transport means are integral. It can be provided that the container body and the transport means are embodied continuous in the area of the second coupling seal. In this variant, the second coupling seal includes the transport means and is preferably connected to the wall of the transport means or attached thereto, in particular via the interior sides of its rabbet body.

One embodiment has proved particularly advantageous in which the container body and/or the transport means has or have at least a first and/or a second recess or opening in the area of the rabbet bodies of the first and/or second sealing strip of the second coupling seal so that the rabbet body of the first sealing strip of the second coupling seal can be positioned largely sealingly against the interior wall of the container body and/or of the transport means and/or against the rabbet body of the second sealing strip of the second coupling seal. Naturally the same can apply in reverse for the rabbet body of the second sealing strip, as well.

It is preferable in this case in particular that the first recess is dimensioned smaller than the rabbet body of the first sealing strip of the second coupling seal so that this rabbet body covers the first recess largely completely, in particular environmentally sealed, and/or in that the second recess is smaller than the rabbet body of the second sealing strip of the second coupling seal so that this rabbet body covers the second recess largely completely, in particular environmentally sealed.

In this case it can preferably be provided that the edge running around the first and/or second recess is largely environmentally sealed with the first and/or second sealing strip or is connected or can be connected to the rabbet body of the first and/or second sealing strip of the second coupling seal, in particular environmentally sealed.

The underlying object of the invention with regard to a metering apparatus is furthermore attained using a container, in particular a precise metering container, for bulk goods, including one at least partly flexible container body, at least one at least partly flexible transport means, containing at least a first opening end, whereby bulk goods can be transferred via the container body into the transport means in the direction of the first opening end, at least a first inventive coupling seal, and at least one metering apparatus present in the transport means, in particular sealingly adapted, having at least one outlet that opens under lateral pressure and that is variably expanding, whereby the first opening end of the transport means is connected or can be connected to the first coupling seal, in particular environmentally sealed. With regard to the container or the container body and the transport means, the aforesaid statements apply correspondingly for this further preferred embodiment. For instance, container body and transport means can also have approximately the same diameter, whereby the transport means then characterize that area of the inventive container that has interior essential areas of the metering apparatus and an opening end. In general the container body has a larger diameter than the transport means in this embodiment as well.

A suitable metering apparatus with at least one variably expanding outlet that opens under lateral pressure can include for instance a disk that is made of flexible material and that is inserted or fitted into the transport means. The circumference of these disks then preferably corresponds [sic] to the cross-sectional surface of the transport means transverse to the passage direction. In one alternative embodiment, the metering apparatus can have a reservoir chamber that extends in the direction of the container body and that is present in particular at least partly in the transport means. In this variant, the metering apparatus can be embodied ill the form of a clip.

In this case, in accordance with another inventive embodiment it can be provided that the metering apparatus is interiorly positioned, at least in part, in particular entirely, in alignment against the transport means, e.g. the interior wall and/or is connected to this transport means or the interior wall. Furthermore transport means and metering apparatus can also be embodied largely in one piece.

The metering apparatus is consequently preferably dimensioned such that it can be added to the transport means in a perfect fit. In this manner a tight seal can be attained with the interior wall of the transport means so that bulk goods can be transferred exclusively through the outlet of the metering device in the direction of the first opening end of the transport means.

In accordance with one particularly preferred embodiment, the outlet of the metering apparatus is embodied in a slit shape. This can be effected for one thing in that the surface of the metering apparatus that has the outlet is indented or nicked over its entire diameter or preferably only partially at least once. In particular for metering apparatus with large dimensions it has proved advantageous to provide the opening slit using two overlapping sections made of flexible material. When the metering apparatus of the alternative embodiment of an inventive metering receptacle[1] is pressed or squeezed together laterally, the longitudinal sides of the material outlet are pressed apart. The outlet opening enlarges as the pressure increases. The lateral pressure can be produced manually or by machine.

[1] Translator's note: The original German uses "Dosierbehältnis", which I translated as "metering receptacle", rather than "Dosiervorrichtung", which is used in all other instances and which I have translated as "metering apparatus".

The underlying object of the invention is furthermore attained using a docking device for environmentally isolated transferring, filling, and/or emptying of the bulk goods and/or fluids, including at least two inventive coupling seals that can be positioned against one another and/or docked to one another, in particular in alignment. In this case, the bottom side of the first coupling seal, in particular the bottom side and/or bottom edge of the rabbet body of the first and second sealing strip, is normally positioned against the top side of the second coupling seal, in particular the top edge and/or edge of the rabbet body of the first and second sealing strip. The coupling seals used for the inventive docking device are preferably matched to one another in shape and size such that when opposing first and second joint bodies and/or first and second coupling seals are actuated with pressure the rabbet bodies of the first and second coupling seal bend apart from one another, in particular uniformly, i.e. they open and close simultaneously. The movement of adjacent rabbet bodies of the first and second coupling seal can be particularly effectively assured e.g. using interleaving coupling apparatus, such as e.g. groove and spring. In this case a spring present for instance on each bottom side or edge of the rabbet bodies of the first and second sealing strip of the first coupling seal is matched in shape and size to a groove that is provided on the top side or edge of the rabbet bodies of the first and second sealing strip of the second coupling seal. In this manner it is possible to keep a bulk goods receptacle sealed against the environment initially until transfer via a first coupling seal attached thereto and also to couple to a second coupling seal in an absolutely environmentally sealed manner, forming an inventive docking device. Furthermore, the transfer process can also be performed in an absolutely environmentally sealed manner since the first and second coupling seals of the docking device are coupled to one another in the opening and closing movement.

The underlying object of the invention with regard to a docking device is furthermore attained using a docking device in which an inventive coupling seal is positioned against or docked to the first coupling seal of an inventive containers in particular in alignment.

In another embodiment of the inventive docking device it is provided that at least one coupling seal, in particular environmentally isolated, can be connected or is connected to a flexible receptacle, in particular in the edge area of the opening.

In this case it can be inventively provided that at least one coupling seal can be connected or is connected to a flexible hose-like shaped body, in particular in the edge area, in particular in an environmentally sealed manner.

The underlying object of the invention is also attained using a holding apparatus for actuating inventive coupling seals and/or inventive docking devices, including a first receiving and/or retention unit for, in particular aligned, receiving and/or retention of the first joint body and/or the first joint cover of a coupling seal or a docking device; a second receiving and/or retention unit for, in particular aligned, receiving and/or retention of the second joint body, which opposes the first joint body, and/or the second joint cover of the coupling seal or docking device; and a positioning mechanism that is configured for moving the first receiving and/or retention unit and the second receiving and/or retention unit towards one another and away from one another, opening and closing the coupling seal or docking device.

The inventive holding apparatus preferably has at least one joint axis of receiving a first and/or second bearing element of the first and/or second sealing strip, in particular of the first and/or second joint body. In this case the first and/or second receiving and/or retention unit can have a bottom and/or top, in particular rotatable or displaceable, fixing mechanism[2]. The travel path for the first and second receiving unit toward one another and/or away from one another can be limited. The holding apparatus can be actuated manually, semiautomatically, and fully automatically and can be used for unlocking, locking, opening, and closing a coupling seal or a docking device. The positioning mechanism can make use e.g. of a rotary joint or of a positioning drive with or without rotary joints. The holding apparatus can also contain at least one pneumatic, hydraulic, or electric motor-driven, in particular semiautomatic or fully automatic, positioning mechanism. A holding apparatus that is e.g. pneumatically operated further enhances reliability during filling, transferring, or emptying of bulk goods. In addition with such an apparatus it is always possible to open and close inventive docking devices in an optimum manner, regardless of their size and/or elastic properties. In addition, the holding apparatus can have at least one suction apparatus that can be or is mechanically linked to the first and/or second holding apparatus and/or to the first and/or second joint cover and/or to the first and/or second joint body of the first and/or second coupling seal. By combining the holding apparatus with a suction apparatus it is possible e.g. after the transfer has concluded and the docking device has been closed and before the first and second coupling seals of the docking device have been decoupled to suction out residual bulk goods that have remained in the area of the joint body. This further reduces the risk of residual contamination when the docking apparatus[3] is decoupled.

[2] Translator's note. The original German uses "Feststellmechanismus" ("fixing mechanism") rather than "Stellmechanismus" ("positioning mechanism"), which is the term used everywhere else in the document.

[3] Translator's note: The original German uses "Andockvorrichtung" ("docking apparatus") rather than "Andockeinrichtung" ("docking device"), which is the term used everywhere else in the document.

Thus underlying the invention is the knowledge that using the inventive configuration of a coupling seal and a docking device for filling and emptying at least partly largely flexible receptacles assures effective contamination-free filling and transferring of bulk goods and/or fluids. Furthermore, the inventive coupling seals and docking devices have an effective structural construction with a very small number of individual components and offer a high degree of reliability and security, even during continuous operation and sustained stress. Technical defects and occurrences of wear can be as good as excluded, even during continuous use. It is furthermore of particular advantage that the [sic] inventive coupling seals and docking devices can be held open for extended periods of time without this having a negative effect on the subsequent closing process and on the adjacent interior sides of the rabbet bodies having a reliable seal. In addition, the inventive coupling seals and docking devices are cost-effective to produce. In one very advantageous embodiment, a coupling seal can even include two identical first and second sealing strips. In the same manner it is now possible to provide a docking device that includes four identical sealing strips, which makes it even easier to produce and handle. Lost individual parts can be replaced with no problem. In addition, the complete cross-section of the through-opening of an inventive coupling seal or a docking device can be used, while according to the known double-cap method the double-cap inserts reduce the seize of the cross-section.

Finally it is also advantageous that the entire coupling seal, including the flexible or extensible element, can be produced from plastic materials and thus does not involve any problems with disposal.

The inventive docking devices and coupling seals are suitable in particular for environmentally isolated filling of flexible receptacles directly from transfer or production systems. In addition, these docking devices and coupling seals can be used with no problem and reliably for filling or emptying e.g. sacks, production systems, formulation systems, extruders, and injection molding and blow-molding machines in a contamination-free manner. In particular when it is important to ensure that only the materials provided for the production are used, e.g. when educt material is added (luring the synthesis of pharmaceutical products or pharmaceutical intermediate or end products, also formulated products, the inventive docking device has proved or the inventive coupling seals have proved extremely advantageous. Very pure plastics for instance can also be attained in a reliable manner in that granulate is added directly to a plastics processing system, e.g. to an extruder, via the inventive docking device, whereby in one preferred embodiment the coupling seals, docking devices, and/or containers can be produced from the same material as the substance to be transferred.

With the inventive docking device, filling and emptying stations in production systems can be configured in a much more cost-effective and simple manner without this entailing any disadvantages with respect to contamination-free work. The inventive coupling seals and docking devices assure both that the environment is not stressed with residual bulk goods and that the bulk goods to be transferred are not contaminated by substances and particles from the environment. In this context, it was also surprisingly found that residual contamination can be entirely prevented by adapting the material or coating material used for the inventive docking devices and coupling seals to the bulk goods material to be transferred. In these cases even the wear that occurs during transferring with the coupling seals does not lead to contamination of the bulk goods, e.g. in the case of polymer granulate. The inventive coupling seals and docking devices thus contribute both to environmental protection and product protection.

Additional features and advantages of the invention result from the following description, in which exemplary embodiments of inventive coupling seals and docking devices are explained in detail using schematic drawings.

Figure 1:
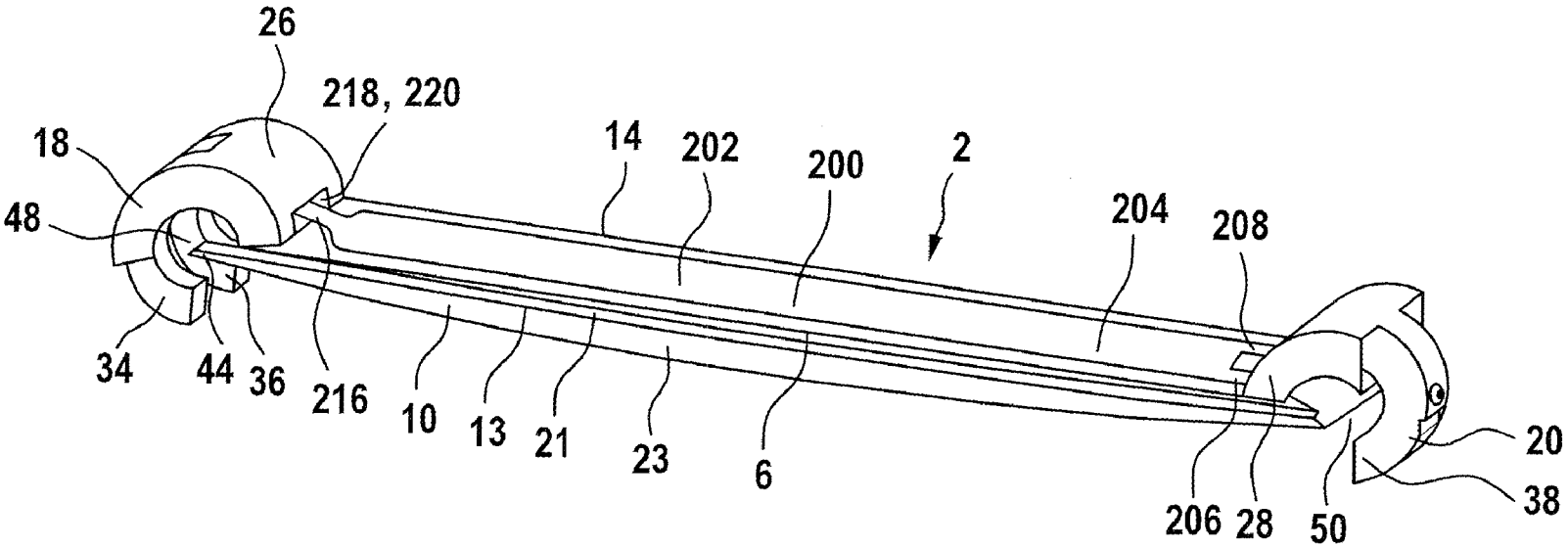
FIG. 1 is a perspective side elevation of an inventive sealing strip.
Figure 5A:
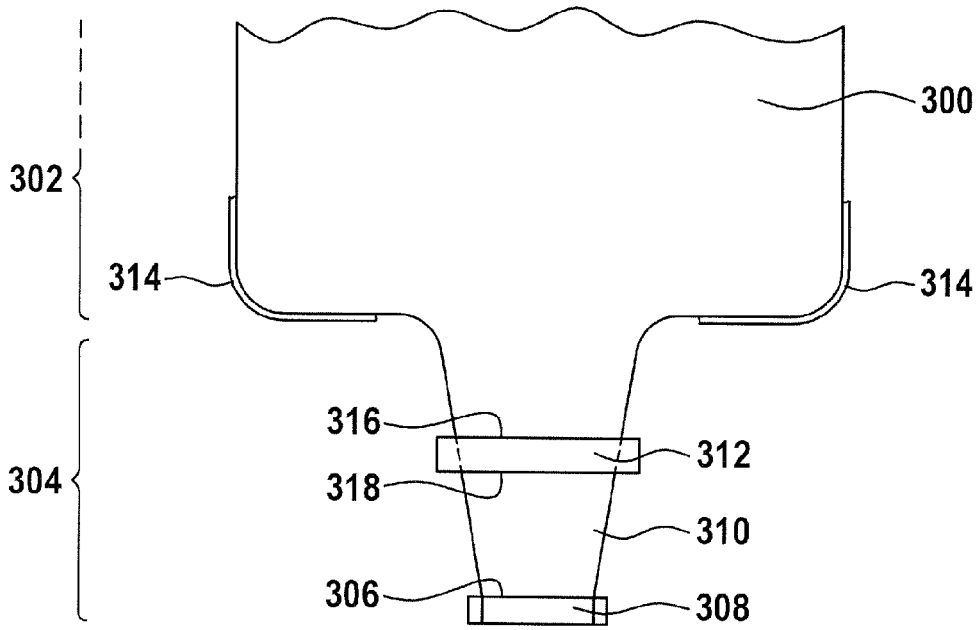
Figure 5B:
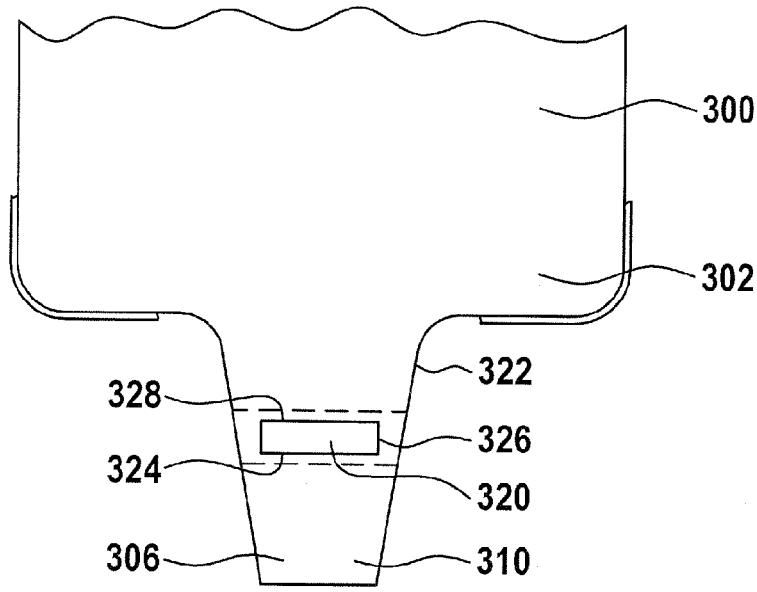
Figure 6:
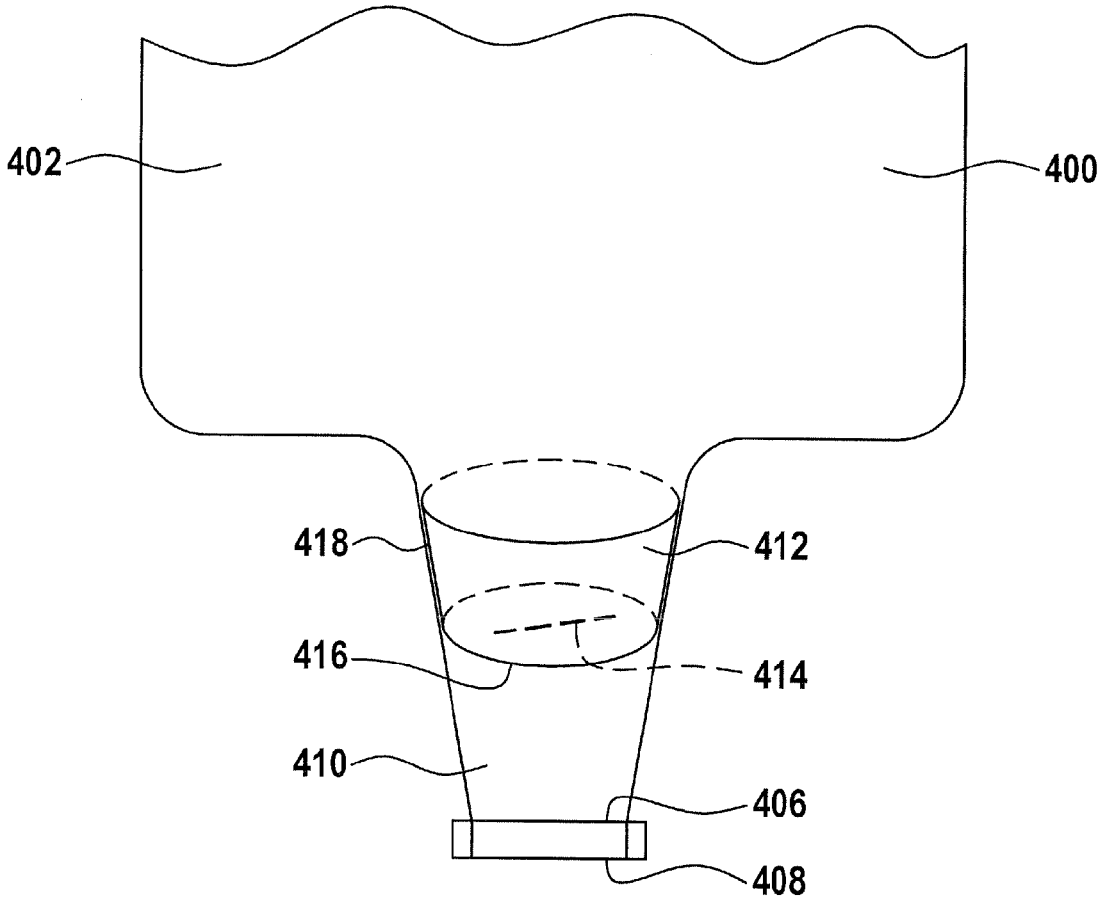

FIG. 5*a* is a top view of an inventive container for fine metering of powdered bulk material;

FIG. 5*b* is a top view of an intermediate productions stage of the metering receptacle in accordance with FIG. 5*a*; and, FIG. 6 is a top view of an alternative embodiment of an inventive container; and FIG. 1 is a schematic side elevation of a first sealing strip 2 of an inventive coupling seal 1. The first sealing strip 2 has a longitudinally shaped rabbet body 6 and a first bearing element 18 on the first end of the rabbet body 6 and a second bearing element 20 on the second end of the rabbet body 6 that opposes the first end. The rabbet body 6 includes an exterior wall 14 and an interior wall 10. The rabbet body 6 furthermore includes an upper or front edge 13 and opposing this a lower or rear edge (not shown). On the interior wall 10 of the rabbet body 6, two additional convex supports can be placed along the longitudinal orientation of the rabbet body 6 or can be an integral component thereof (not shown). These convex supports are components of a particularly preferred embodiment of an invent coupling seal. The inventive coupling seal 1 naturally also includes those embodiments in which there are no convex supports. The rabbet body 6 can furthermore be divided into an exterior segment 21 made e.g. of an only moderately elastic, for instance thermoplastic, material and an interior segment 23 made of an elastic material. Such material combinations can be obtained for instance by means of coextrusion or multi-component injection molding in a single work step and are also known as dual components. The first bearing element 18 is attached in the area of the first end 44 of the rabbet body 6 with a extension 26 on the exterior side 14 of the rabbet body 6. Similarly, the second bearing element 20 is embodied on the second end 66 of the rabbet body 6 with an extension 28. The first and second bearing elements 18 and 20 in a sectional view are largely in the shape of circular rings, i.e. the supports or support arms are not closed to form a complete circle. In accordance with FIG. 1, the first bearing element 18 includes two support arms 34 and 36 that are spaced apart from one another. The distance between these two support arms is selected such that a support arm 38' of a second sealing strip 4 can be received therein (not shown). The support arms 34 and 36 or the first bearing element 18 enclose at least in part a space 48 into which the first end 44 of the rabbet body 6 projects. This first end 44 is preferably located in about the center of the interior space 48 suggested by the circular ring-shaped support arms 34 and 36. Preferably both the exterior surfaces and the interior surfaces of the support arms 34 and 36 are embodied as cylinder segments. The second bearing element 20 includes an extension 28 that is continued by the support arm 38. The second end 66 of the rabbet body 6 is also preferably placed in about the center of the interior space 50 suggested by the support arm 38.

Located on the exterior side 14 of the rabbet body 6 is a flexible element 200 in the form of a strip that extends between the first and second bearing elements 18 and 20. The second end 204 of the strip 200 has two projection projections 206, 208 that are present inserted into corresponding notches 212 and 214 (not shown). The notches 212 and 214 form the first fixing device 210 (not shown) that in the present case is a component of the bearing element 20. Present on the first end 202 of the strip 200 is a projection 216 that is present inserted into a corresponding notch 218. The notch 218 in like manner forms the second fixing device 220 and is a component of the first bearing element 18. The flexible element 200 made e.g. of fiberglass composite material is preferably curved when in the normal state. As soon as it is held in the fixing devices 210 and 220, the exterior side 14 consequently experiences a force such that in the inventive coupling seal the interior sides of both sealing strips are pressed against one another. The length of the flexible strip 200 is determined such that the strip when installed extends largely across the entire length between the first and second bearing elements. The projections 206, 208, and 216 are dimensioned such that even if the sealing strip is severely outwardly arched, i.e. in the opened state of the coupling seal, the projections still always remain in the fixing devices 210 and 220.

Figure 2:
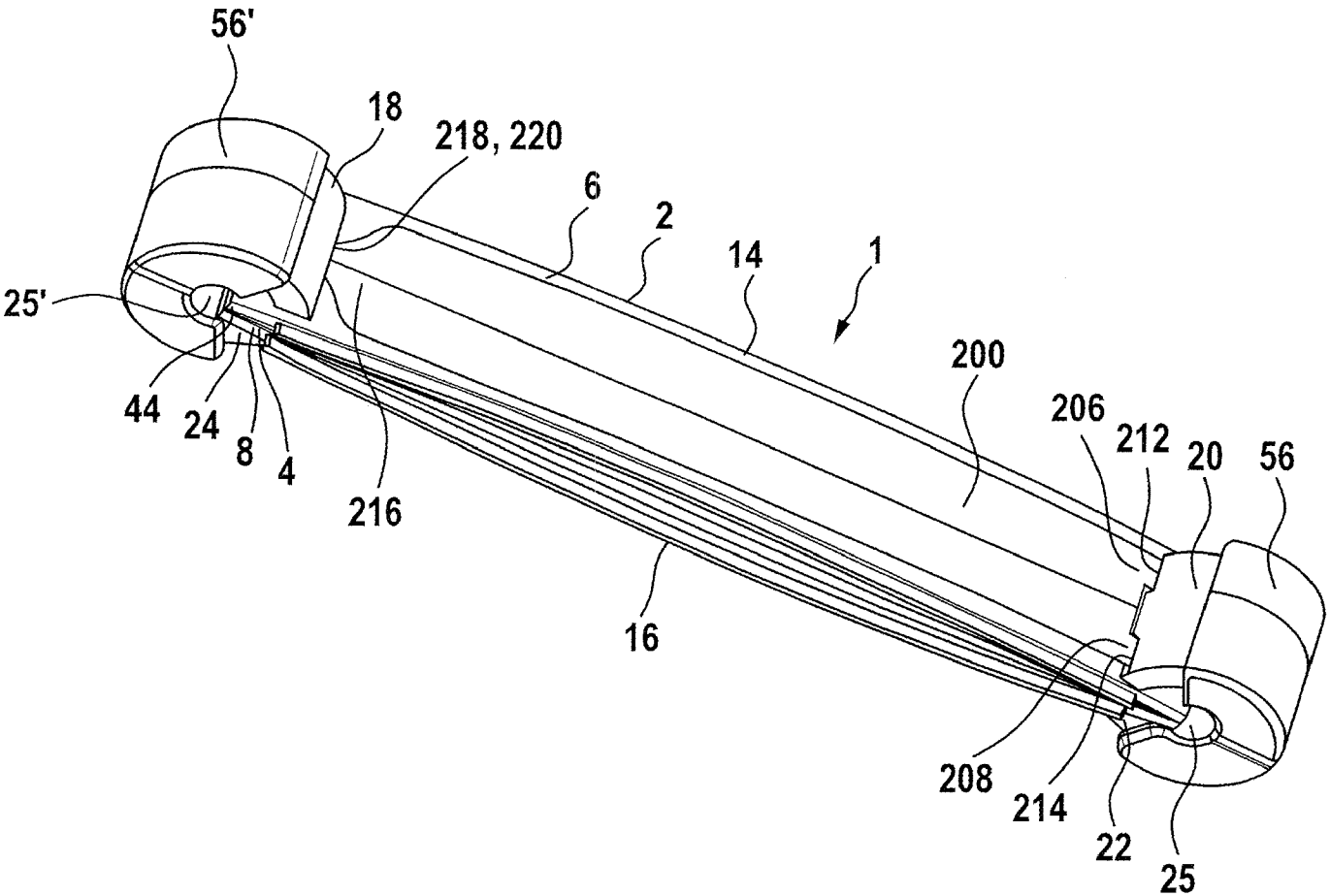
FIG. 2 is a perspective elevation of an inventive coupling seal.

As shown in FIG. 2, the inventive coupling seal 1 can be obtained in that a first sealing strip 2 with a second sealing strip 4, which can be largely identical to the sealing strip 2, can be placed upon one another along the interior sides of their rabbet bodies 6 and 8. In doing so, the first end 44 of the rabbet body 6 of the first sealing strip 2 is positioned against with the second end of the rabbet body of the second sealing strip 4 and the second end of the rabbet body of the first sealing strip 2 is positioned against the first end of the rabbet body of the second sealing strip 4, and the support arm 38 of the first sealing strip 2, covered by the joint cover 56, engages in a first bearing element 22 of the second sealing strip 4, containing spaced apart support arms 34' and 36', covered by the joint cover 56, and a support arm 38' of the second sealing strip 4 engages, covered by the joint cover 56', in the first bearing element 18, containing the support arms 34 and 36, covered by the joint cover 56', forming joint bodies 25 and 25'. The interior walls 10 and 12 of the rabbet bodies 6 and 8 of the first and second sealing strips 2 and 4 are positioned against one another. If the interleaved first and second bearing elements 18, 20, 22, 24 of the first and second sealing strips 2, 4 are arranged aligned one above the other, forming the first and second joint bodies 25, 25', due to the elastic properties of the rabbet bodies 6 and 8 and the rounded configuration of the interior walls 10 and 12 this leads to a slightly rounded outward arching of the exterior walls 14, 16 of the rabbet bodies 6 and 8 in the assembled coupling seal 1. Again the flexible strip 200 present in the fixing devices 210 and 220 can be seen on the exterior side of the sealing strip 2.

The flexible strip 200 molds itself tightly on the exterior side of the sealing strip 2. The projections 206 and 208[4] engage in the notches 212 and 214 of the bearing element 20. In like manner the projection 216 is present in the notch 218 of the fixing device 220. If the joint bodies 25 and 25' are now pressed against one another, the rabbet bodies of the first and second sealing strip 2 and 4 bend outward. This movement is opposed by the flexible element 200. Since the projections have little clearance in the notches, if the rabbet bodies are outwardly displaced, the flexural stiffness of the strip 200 that acts against this displacement can act directly on the exterior side of the rabbet bodies.

[4] Translator's note: The original German uses "Vorsätze", the plural form of "Vorsatz", but everywhere else in the document these elements are identified as "Vorsprünge", the plural form of "Vorsprung". Translator believes that "Vorsprünge" was intended, and translation reflects this.

Figure 3:
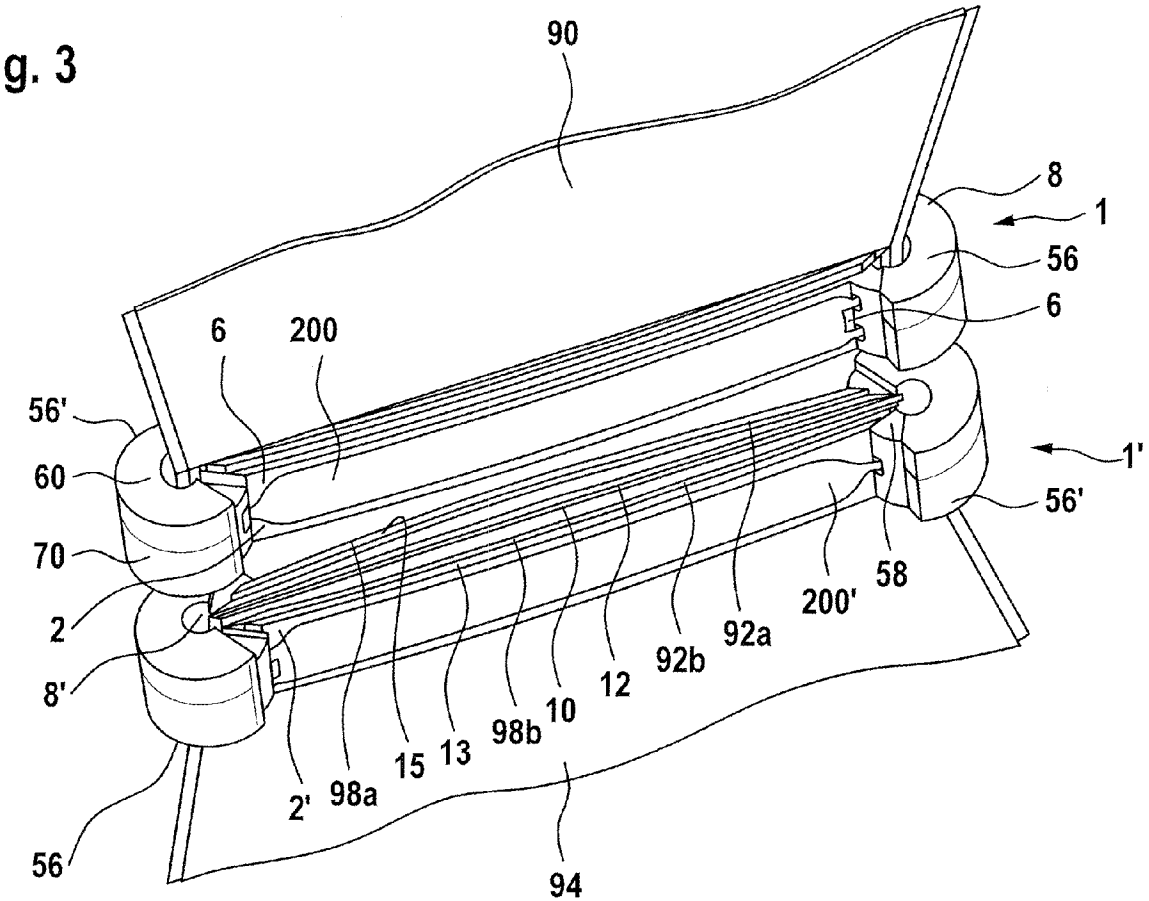
FIG. 3 is a perspective elevation of two inventive coupling seals prior to docking forming an inventive coupling seal.

FIG. 3 depicts a side elevation of two inventive coupling seals 1 and 1'. The first and second bearing elements of the first and second sealing strip are each enclosed by the first and second joint cover halves 60 and 70, forming the joint cover 56. The interior walls 10 and 12 of the rabbet bodies of the first and second sealing strips are pressed against one another in the normal state so that the bag 90 is completely sealed.

Contributing to this for one thing are the interior walls of the rabbet bodies 6 and 8, which are arched in the normal state, and which when adjacent bearing elements are fixed in the joint covers 56, 56' at the two ends of the sealing strips, forming a largely straight sealing slit, are positioned against one another. In the embodiment depicted, the edge areas of the flexible bag 90 are attached in the area of the interior walls 10 and 12 of the rabbet bodies 6 and 8, it having proved particularly advantageous to extend this attachment up to the opposing first and second ends of the rabbet bodies so that the point at which the bag edge reverses its direction largely coincides with the point of rotation of the rabbet bodies when the sealing strips are open and closed. In this manner the bag is not stressed or is least stressed when the coupling seal is opened and closed, so that material fatigue or tears that could lead to environmental contamination are prevented. The edge of the flexible bag 90 is preferably attached in the area of the lower edges of the rabbet bodies 6 and 8, i.e. in the transition are from the interior wall to the exterior wall. This can occur for instance by means of adhesive. This type of attachment has the advantage that the bag wall is positioned against the exterior edge of the interior wall or on the convex supports, however. Because if adhesive material is not used in the rest of the entire interior wall areas, the elastic properties of the interior wall are permanently maintained. Consequently secure sealing is ensured using the interior walls or convex supports thereof that come to be positioned against one another in the inventive coupling seals 1 and 1'. As can be seen in particular in the coupling seal 1' in FIG. 3, the movement clearance of the first and second sealing strip is specified by the opening angle 58 of the joint cover 56'. If the opposing joint covers of a coupling seal are pressed against one another, the first and second sealing strips move away from one another, opening the bag. In order to prevent overworking of the coupling seal from the very beginning, the maximum spread of the sealing strips is defined via the opening angle 58 of the joint covers 56 and 56'. Because as soon as the exterior sides of the first and second sealing strips of a coupling seal strike the edges of the joint cover that define the opening angle 58, it cannot be opened further without damage. Likewise, a system made from the retention pin and the retention opening and a system made of the concavity and retention bolt can be contribute to limiting the opening angle.

Another flexible bag, for instance, or a flexible transfer hose 94 can be attached to the coupling seal 1' in the same manner as a flexible bag 90 is attached in the coupling seal 1. The coupling seals 1 and 1' have essentially the same dimensions and when coupled to one another embody an inventive docking device 96. Environmentally insulated docking can be attained in one preferred embodiment in that attached or worked in along the upper edge courses 98*a* and 98*b* or on the upper sides 13, 15 of the rabbet bodies 6, 8 of the first and second sealing strip 2 and 4 of the second coupling seal 1' are grooves 92*a*, 92*b* that can be inserted, preferably in a perfect fit, into corresponding spring elements 114*a*, 114*b* present in the bottom sides of the rabbet bodies 6, 8 of the first and second sealing strip 2 and 4 of the coupling seal 1. As already described for FIGS. 1 and 2, flexible strips that are moveable in the fixing devices of the bearing elements are present on the exterior sides of the wall bodies.

Figure 4:
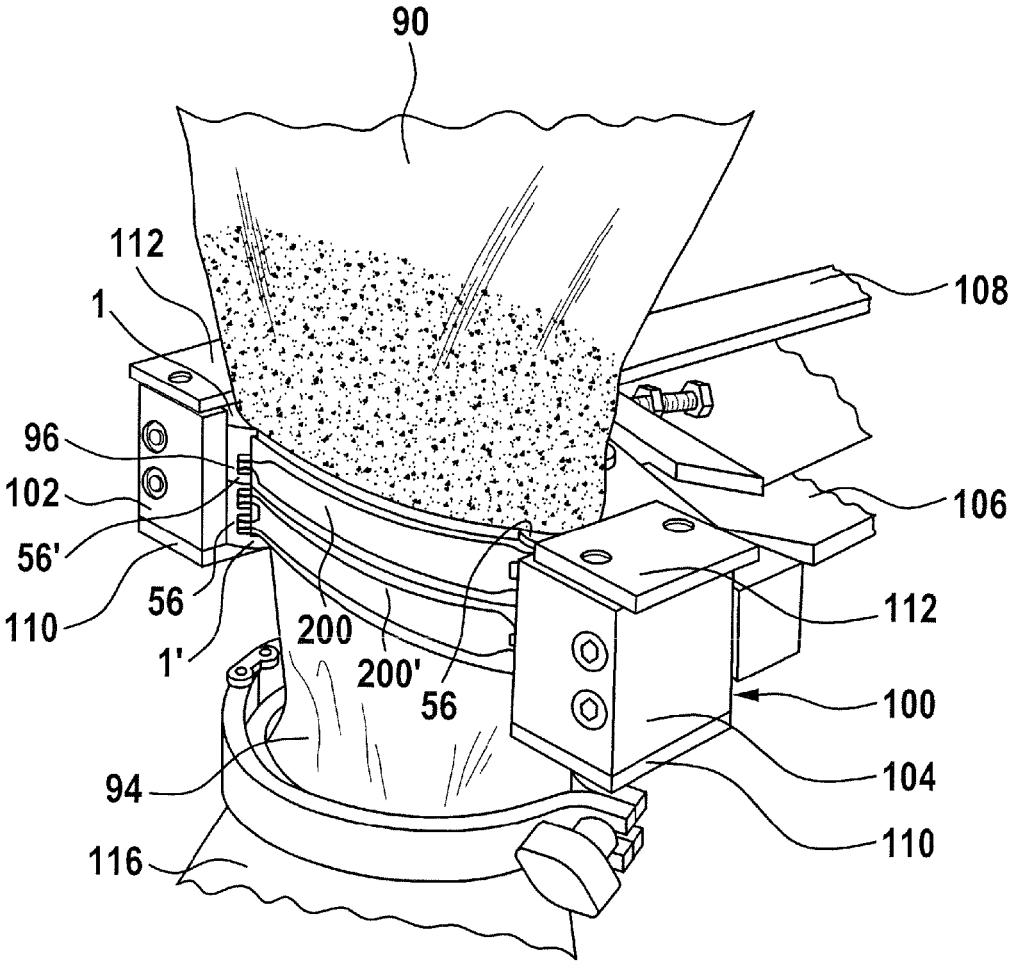
FIG. 4 is a perspective depiction of an inventive holding apparatus containing an inventive docking device in the open state.

FIG. 4 depicts an inventive holding apparatus 100 having a first receiving unit 102 and a second receiving unit 104 and lever arms 106 and 108. The receiving units 102 and 104 are configured such that they can receive the joint covers 56, 56' of the coupling seals 1 and 1' aligned at least in part. Preferably at least sections of the receiving unit and the joint cover behave like negative and positive fit shapes. The coupling seal 1' is already inserted into the holding apparatus 100, whereby the transfer hose 94 is connected to a receptacle 116 that is to be filled. As already shown in FIG. 3, the coupling seal 1 has spring elements 114*a* and 114*b* (not shown) on the top side of the sealing strips or rabbet bodies. Correspondingly, the coupling seal 1 has, on the bottom sides of the sealing strips or rabbet bodies, grooves 92*a* and 92*b* (not shown) for receiving the spring elements of the coupling seal 1'. The coupling seal 1' is held on its bottom side in the receiving units 102 and 104 via bottom plates 110. As depicted in FIG. 4, after inserting the coupling seal 1 into the holding apparatus 100, the upper holding plates 112 can be guided over the top sides of the joint covers 56 or 56' of the coupling seal 1 and fastened e.g. by means of screws. The receiving units 102 and 104 are advantageously dimensioned such that by fastening or screwing on the upper holding plate 112, the springs 114*a*, 114*b* and grooves 92*a*, 92*b* are moved into one another until they make contact. In this manner an absolutely environmentally isolated docking device 96 is obtained with which any bulk goods can be transferred into fixed or transportable receptacles 116, as depicted in FIG. 4. For this purpose, the lever arms 106 and 103 are actuated in that the first and second receiving units 102 and 104 are moved towards one another. Because of this, the first and second sealing strips of the first and second coupling seal 1 and 1' move uniformly away from one another, opening both the flexible bag 90 and the flexible transfer hose 94. Present on the exterior sides of the rabbet bodies of the sealing strips are flexible strips 200 and 200' that are held at their opposing ends in fixing devices that are components of the bearing elements. When for instance the flexible bag 90 and also the flexible transfer hose 94 are each moved up to the exterior edge of the rabbet bodies or sealing strips, these edges strike one another when the coupling seals are coupled to create a docking station so that not a single component of the inventive docking device comes into contact with the bulk goods when these bulk goods are being transferred. Once the bag has been removed and a new bag has been attached, the inventive docking device can continue to be used in a contamination-free manner, without additional cleaning steps being required. Removing the docking device from the holding apparatus 100 is just as simple as installing it. After the upper holding plate 112 has been removed, the coupling seals 1 and 1' can be separated from one another with nothing further, specifically while closed, so that even after filling or transferring there is no fear of contaminating the environment or the transferred products.

FIG. 5*a* depicts an inventive container 300 for precise metering of in particular powder or granulate bulk goods. This flexible container 310 includes a container body 302 and a section 304 section that tapers to the outlet. Following this section 304, interrupted by the second coupling seal 312 of the transport means 310, at its opening end 306 an inventive first coupling seal 308 is attached environment-tight [sic]. Thus attached to the container body 302 is a hose-like transport means 310 that is normally narrower than the bag body 302. The bag body can be placed e.g. in such a configuration for precisely metered discharge head-first onto metering jaws 314 through which the transport means 310 projects. An inventive second coupling apparatus[5] 312 is attached in the transition between the tapering container body 302 and the transport means 310 for precise metering of the bulk material to be transferred. In one embodiment, this coupling seal can be placed or drawn onto the transport means 310 from outside in a simple manner so that it encloses the latter. The sealing strips or rabbet bodies of this second coupling seal 312 are preferably adhesively joined to the exterior wall of the transport means, e.g. if the transport means 310 and container body 302 are a single piece. Naturally it is also possible to connect the container body 302 and transport means 310 as separate components to the second coupling seal 312. In this case the opening edge 310 of the container body 3(02 is preferably connected to the upper section of the sealing strips, in particular the interior sides of the rabbet bodies, and the first opening 318 of the transport means 310 is connected, especially circumferentially, to the lower area of the sealing strips of the second coupling seal 312, in particular the interior sides of the rabbet bodies of the first and second sealing strips, especially in an environmentally sealed manner. In this type of embodiment, sections of the interior sides or opposing rabbet bodies of the second coupling seal 312 come into direct contact with one another. It has been determined that precise metering, even of very fine-particle bulk goods, is particularly effective when such direct contact is permitted between the interior sides of the elastic rabbet bodies of the second coupling seal 312.

[5] Translator's note: The German text here is Kupplungsvorrichtung, literally coupling apparatus, rather than Kupplungsverschluβ (coupling seal), which is used elsewhere in the text.

FIG. 5*b* depicts a particularly preferred embodiment of an integral container 300 in an intermediate production step. Provided in the transition between container body 302 and transport means 310 on the front and back sides of the container are recesses 320 and 322 that are each dimensioned smaller than the rabbet bodies of the first and second sealing strip of the second coupling seal 312. In general it is sufficient to permit very narrow edge strips 324 and 326 to remain in the edge areas of the transport means 310 and container body 302. Then the rabbet bodies of the coupling seal are positioned against or are connected in an environmentally sealed manner to the edge 328 surrounding the recess in the area indicated by the broken lines.

The manner in which the metering container 300 functions is described in detail in the following. The vessel to be filled (not shown) itself has an inventive coupling seal that can be coupled to the first coupling seal 308 of the container 300, creating an inventive environmentally sealed docking device. This docking process is preferably performed after the container 300 that is to be emptied in a controlled manner has been placed in a suitable emptying position, for instance using suitable metering jaws 314. As long as the first coupling seal 308 of the container 300 has not formed an environmentally sealed docking device with the coupling seal of the receptacle to be filled, the second coupling seal 312 preferably remains sealed, i.e. the interior sides of the rabbet bodies of the first and second sealing strips are sealingly adjacent to one another immediately or not immediately, that is separated by the bag walls. It has proved particularly advantageous when the interior elastic segments of the rabbet body, in particular on their opposing longitudinal sides, project beyond the exterior thermoplastic segment of the rabbet body. By applying pressure, the created docking device is opened so that the vessel is ready for filling. Then the second coupling seal 312 is also actuated with pressure, preferably using a pneumatic and in particular electric drive apparatus so that bulk goods can travel, forced by gravity, out of the container body 302 into the vessel to be filled. Naturally the filling process can be supported using suitable apparatus, such as vibrators or activators. The filling speed can be varied depending on the force exerted, i.e. the effective through surface area that is included in the spaced apart rabbet bodies. Generally a gap of just 1 to 2 mm is sufficient for precise metering. The accuracy of the metering process can be further enhanced, in particular for very fine particle bulk goods, by the use of a vibrator.

FIG. 6 depicts an alternative embodiment of an inventive metering container 400, including a container body 402 and a transport means 410. Again an inventive coupling seal 408 is present on the first opening end 406 of the transport means. Instead of using a second inventive coupling seal for precise metering of in particular powder bulk materials, as shown in FIG. 5*a*, in the embodiment in accordance with FIG. 6 a metering apparatus 412 having at least one variably expanding outlet 414, in the form of a slit, is used that opens under lateral pressure. This metering apparatus 412 is attached interiorly in the transport means 410 or in the transition between container body 402 and transport means 410. In that this metering apparatus 412 is connected totally circumferentially environmentally sealed to the transport means 410 or its interior wall (for reasons of illustration in FIG. 6 a total circumference, but not total surface, connection is shown between the interior wall of the transport means and the exterior side of the metering apparatus), for instance with an adhesive agent or by means of welding, it is assured that bulk goods can travel only via the outlet 414 of this metering apparatus 412 through the transport means 410 in the direction of the first coupling seal 408. It has proved particularly advantageous when the metering apparatus 412 has not only a flexible disk separating the passage of the transport means 410, but also wall elements 418[6] extending away from this disk 416, in particular in the direction of the container body 402, that can be joined to the interior wall of the transport means 410. This preferably circumferential wall 418 then forms together with the largely disk-shaped separation[7] 416*a* type of supply space. Naturally it is also possible that this wall extends from the flexible disk 416 in the direction of the first opening end 406 of the transport means 410 or both in the direction of the opening end 406 and in the direction of the container body 402.

[6] Translator's note: The original German uses "Wandelemente", which I translated as "wall elements", rather than "Wandung", which is used later and which I have translated as "wall".

[7] Translator's note: The original German uses "scheibenförmige Abtrennung", which I translated as "disk-shaped separation", rather than "Scheibe", which is used in all other instances and which I have translated as "disk".

The features of the invention disclosed in the foregoing description, drawings, and in the claims can be essential, both individually and an any desired combination, for providing the invention in its various embodiments

REFERENCE LIST

1, 1' Coupling seal
2 First sealing strip
4 Second sealing strip
6 Rabbet body of the first sealing strip
8 Rabbet body of the second sealing strip
10 Interior side of the rabbet body of the first sealing strip
12 Interior side of the rabbet body of the second sealing strip
13 Top side of the rabbet body of the first sealing strip
14 Exterior side of the rabbet body of the first sealing strip
15 Upper edge of the rabbet body of the first sealing strip
16 Exterior side of the rabbet body of the second sealing strip
17 Bottom side of the first sealing strip
18 First bearing element of the first sealing strip
19 Lower edge of the rabbet body of the first sealing strip
20 Second bearing element of the first sealing strip
21 Exterior segment of the sealing strip or rabbet body
22 First bearing element of the second sealing strip
23 Interior segment of the sealing strip or rabbet body
24 Second bearing element of the second sealing strip
25 First joint body
25' Second joint body

26 Extension of the first bearing element of the first sealing strip
28 Extension of the second bearing element of the fist sealing strip
30 Extension of the first bearing element of the second sealing strip
32 Extension of the second bearing element of the second sealing strip
34 Support arm of the first bearing element 18
36 Support arm of the first bearing element 18
38, 38' Support arm of the second bearing element 20
40 Elastic component of the rabbet body
44 First end of the rabbet body 6
46 Second end of the rabbet body 6
48 First interior space
50 Second interior space
56 First joint cover
56' Second joint cover
58 Opening angle of the joint cover
66 Second end of the rabbet body 6
68 Receiving space for the joint cover half 60
90 Bag
92*a*, 92*b* Grooves
94 Transfer hose
96 Docking device
98*a*, 98*b* Upper edge courses of first and second sealing strips 2 and 4
100 Holding apparatus
102 First receiving unit
104 Second receiving unit
106 First lever arm
108 Second lever arm
110 Bottom plate
112 Top holding plate
114*a*, 114*b* Spring element
116 Receptacle
120 Advancing support
122 Recess
124 Recess
126 Side edge area
128 Side edge area
130 Pneumatic positioning drive
132 Pneumatic cylinder
136 Coupling
138 Locking pin
200, 200' Elastic element
202 First end of the flexible element
204 Second, opposing end of the flexible element
206 Projection, tongue of flexible element
208 Projection, tongue of flexible element
210 Fixing device
212 Notch
214 Notch
216 Projection, tongue of flexible element
218 Notch
220 Fixing device
300 Metering container
302 Container body
304 Tapering second of container body
306 Opening end of transport means
308 First coupling seal
310 Transport means
312 Second coupling seal
314 Metering jaws
316 Outlet
318 Second opening end
320 Recess
322 Recess
324 Edge strip
326 Edge strip
328 Recess of circumferential edge
400 Metering container
402 Container body
406 First opening end
408 Coupling seal
410 Transport means
412 Metering apparatus
414 Slit-like outlet
416 Flexible disk of metering apparatus
418 Wall in the metering apparatus

The invention claimed is:

1. A coupling seal for environmentally isolated transferring, filling, or emptying of receptacles, comprising:

at least a first sealing strip containing at least one rabbet body that is at least partly elastic having an interior side, an exterior side, a top side or edge and/or a bottom side or edge, at least a first bearing element on a first end of said rabbet body, and at least a second bearing element on a second end of said rabbet body that opposes the first end;

at least a second sealing strip containing at least one rabbet body that is at least partly elastic having an interior side, an exterior side, a top side or edge and/or a bottom side or edge, at least a first bearing element on a first end of said rabbet body, and at least a second bearing element on a second end of said rabbet body that opposes the first end, wherein said interior sides of said rabbet bodies of said first and second sealing strips are positioned to seal against one another, at least in sections, such that said first bearing element of said first sealing strip is arranged adjacent to said second bearing element of said second sealing strip and said second bearing element of said first sealing strip is arranged adjacent to said first bearing element of said second sealing strip, in each case with said interior sides of said rabbet bodies of said first and second sealing strips at least partially positioned against one another, forming first and second joint bodies;

at least a first flexible element with opposing first and second ends that, within these first and second ends, extends at least between a first fixing device of said rabbet body of said first sealing strip and a second fixing device of said rabbet body of said first sealing strip; and at least a second flexible element with opposing first and second ends that, within these first and second ends, extends at least between a first fixing device of said rabbet body of said second sealing strip and a second fixing device said rabbet body of said second sealing strip.

2. The coupling seal of claim 1, wherein said first and second fixing devices of said first and second sealing strips are present at or on said exterior side of said rabbet body of said respective first and second sealing strips.

3. The coupling seal of claim 1, wherein said first and second bearing elements of said first and second sealing strips include said first and second fixing devices of said first and second sealing strips.

4. The coupling seal of claim 1, wherein said first or second flexible element includes a component in the form of a strut, bar, or strip made of metal and/or a composite material.

5. The coupling seal of claim 1, wherein said first or second end of said first and second flexible elements is at least partially insertable into said first or second fixing device of said first and second sealing strips.

6. The coupling seal of claim 1, wherein said first and second flexible elements when installed have a pre-stress.

7. The coupling seal of claim 1, wherein the first and second ends of said first and second flexible elements of said first and second sealing strips are connected to said first and second fixing devices of said first and second sealing strips.

8. The coupling seal of claim 1, further comprising:

at least a first joint cover that is arranged, while forming a rotary bearing, at least in part over or about said first joint body, mutually adjacent said first and second bearing elements of said first or second sealing strip;

at least a second joint cover that is arranged, while forming a rotary bearing, at least in part over or about said second joint body, mutually adjacent said second and first bearing elements of the first or second sealing strip; and at least a first joint axis for being received into a first interior space for rotatable bearing of said first joint body of said first and second bearing elements of said first or second sealing strip, and at least a second joint axis for being received into a second interior space for rotatable bearing of said second joint body of said second and first bearing elements of said first or second sealing strip.

9. The coupling seal of claim 1, wherein the first bearing element of the first and second sealing strips is in the form of a first hinge element and the second bearing element of the first and second sealing strips is in the form of a second hinge element, and wherein the first hinge element of said first sealing strip and the second hinge element of said second sealing strip embody a first hinge, and the second hinge element of said first sealing strip and the first hinge element of said second sealing strip embody a second hinge.

10. The coupling seal of claim 1, wherein said first and second bearing elements of said first and second sealing strips resemble at least in part the shape of a circular ring.

11. The coupling seal of claim 1, wherein said first and second bearing elements of said first and second sealing strips are attachable to said exterior side of said first or second end of said rabbet body of said first and second sealing strips.

12. The coupling seal of claim 1, wherein said first and second bearing elements do not extend to said interior side of said rabbet body of said first or second sealing strip.

13. The coupling seal of claim 8, wherein said first and second joint covers have interior dimensions that largely coincide with the exterior dimensions of said adjacent first and second bearing elements so that in the case of mutually adjacent interior sides of said rabbet bodies of said first and second sealing strips, said first joint cover at least partially includes, at least partly aligned, said first and second bearing elements of said first or second sealing strip and said second joint cover at least partially includes, at least partly aligned, said second and first bearing elements of said first or second sealing strip, forming a rotary bearing.

14. The coupling seal in accordance with of claim 8, wherein said first and second joint covers include a joint cover lid with a joint axis that is configured for insertion into said first interior space formed from said first and second bearing elements of said first and second sealing strips or into said second interior space formed from said second and first bearing elements of said first and second sealing strips.

15. The coupling seal of claim 8, wherein said first or second joint cover includes a first and a second joint cover half.

16. The coupling seal of claim 8, wherein the first end of said rabbet body of said first sealing element and the second end of said rabbet body of said second sealing element project into said first interior space and the second end of said rabbet body of said first sealing strip and the first end of said rabbet body of said second sealing strip projects into said second interior space.

17. The coupling seal of claim 1, wherein said first bearing element of said first and second sealing strips includes at least by section at least one circular ring-shaped body, and wherein said second bearing element of said first and second sealing strips includes at least two circular ring-shaped bodies spaced apart from one another, whereby the circular ring-shaped body of said first bearing element is configured to fit between the two circular ring-shaped bodies of said second bearing element that are spaced apart from one another, forming a first joint body, and whereby the circular ring-shaped body of said second bearing element is configured to fit between the two circular ring-shaped bodies of said first bearing element that are spaced apart, forming a second joint body, in each case forming an interior space for receiving at least one joint axis.

18. The coupling seal of claim 1, wherein at least one interior wall of said rabbet bodies of said first and second sealing strips has at least one convex support and at least one concave channel between said convex support and a top longitudinal edge of said interior wall and at least one concave channel between said convex support and a bottom longitudinal edge of said interior wall.

19. The coupling seal of claim 1, further comprising a flexible receptacle or a flexible hose that is attachable to or is present on said interior side, exterior side, top edge, or bottom edge of said rabbet bodies of said first and second sealing strips.

20. The coupling seal of claim 19, wherein said receptacle or hose covers the entire interior side of said rabbet bodies of said first and second sealing strips.

21. The coupling seal of claim 1, wherein said first and said second sealing strips or their rabbet bodies have on said top and/or bottom side, at least one coupling apparatus spring.

22. The coupling seal of claim 20, wherein said first and second sealing strips or their rabbet bodies have on said top side a groove or a tongue and on said bottom side a tongue or a groove.

23. The coupling seal of claim 1, wherein said first and second sealing strips largely coincide in terms of their shape and size.

24. The coupling seal of claim 1, wherein said rabbet body of said first and second sealing strips has at least one elastomer or thermoplastic/elastomer segment at or on the interior side.

25. The coupling seal of claim 1, wherein the exterior side of said rabbet body of said first and second sealing strip includes, at least in areas, a thermoplastic material.

26. The coupling seal of claim 1, wherein said bearing elements or exterior sides of said rabbet bodies of said first or second sealing strip contain, at least in sections thermoplastic polymers.

27. A coupling seal for environmentally isolated transferring, filling, or emptying of receptacles, comprising:

at least a first sealing strip containing at least one rabbet body that is at least partly elastic having an interior side and an exterior side;

at least a second sealing strip containing at least one rabbet body that is at least partly elastic having an interior side and an exterior side, whereby said interior sides of said rabbet bodies of said first and second sealing strips are positioned to seal against one another, at least in sections, and to reversibly open given actuation by force, forming a through-opening; and at least a first flexible element that is positionable against said exterior side of said rabbet body of said first sealing strip or connectable to said rabbet body of said first sealing strip, and at least a second flexible element that is positionable against said exterior side of said rabbet body of said second sealing strip or connectable to said rabbet body of said second sealing strip.

28. The coupling seal of claim 1, wherein the first fixing device of said first sealing strip is on or adjacent to the first end of said rabbet body of said first sealing strip and said second fixing device of said first sealing strip is on or adjacent to the second end of said rabbet body of said first sealing strip; and wherein the first fixing device of said second sealing strip is on or adjacent to the first end of said rabbet body of said second sealing strip and the second fixing device of said second sealing strip is on or adjacent to the second end of said rabbet body of said second sealing strip.

29. The coupling seal of claim 4, wherein the composite material is a carbon, aramide, and/or fiberglass composite material.

30. The coupling seal of claim 12, wherein said first and second bearing elements have a center square ranging from 90° to 240°.

31. The coupling seal of claim 18, wherein both interior walls of said rabbet bodies of said first and second sealing strips have at least one convex support and at least one concave channel between said convex support and the top longitudinal edge of said interior wall and at least one concave channel between said convex support and the bottom longitudinal edge of said interior wall.

32. The coupling seal of claim 19, wherein said receptacle or hose is attachable to or is present on said interior side, exterior side, top edge, or bottom edge of said rabbet bodies of said first and second sealing strips along the entire length of said rabbet bodies.

33. The coupling seal of claim 20, wherein the edge of the receptacle or hose approximately coffesponds to and/or projects beyond the edge of the interior side of said rabbet bodies of said first and second sealing strips.

34. The coupling seal of claim 21, wherein said at least one coupling apparatus encompasses the section between said interior side and said exterior side of said rabbet body of said first and second sealing strips.

35. The coupling seal of claim 24, wherein the at least one elastomer or thermoplastic/elastomer segment at or on the interior side extends across the entire length of the interior side.

36. The coupling seal of claim 26, wherein said thermoplastic polymers include at least one of polyoxyalkylene, polyoxymethylene (POM), polyolefines, polystyrene, styrene copolymers, polyamides, poly(meth)acrylates, PVC, and/or polyketones, including alternating carbon monoxide/ethylene copolymers.

37. A coupling seal for environmentally isolated transferring, filling, or emptying of receptacles, comprising:

at least a first sealing strip, containing at least one rabbet body that is at least partly elastic having an interior side, an exterior side, a top side or edge and/or a bottom side or edge, at least a first bearing element on a first end of said rabbet body, and at least a second bearing element on a second end of said rabbet body that opposes the first end;

at least a second sealing strip, containing at least one rabbet body that is at least partly elastic having an interior side, an exterior side, a top side or edge and/or a bottom side or edge, at least a first bearing element on a first end of said rabbet body, and at least a second bearing element on a second end of said rabbet body that opposes the first end, wherein said interior sides of said rabbet bodies of said first and second sealing strips are positioned to seal against one another, at least in sections, such that said first bearing element of said first sealing strip is arranged adjacent to said second bearing element of said second sealing strip and said second bearing element of said first sealing strip is arranged adjacent to said first bearing element of said second sealing strip, in each case with said interior sides of said rabbet bodies of said first and second sealing strips at least partially positioned against one another, forming first and second joint bodies;

at least a first flexible element with opposing first and second ends that, within these first and second ends, extends at least between a first fixing device of said rabbet body of said first sealing strip and a second fixing device of said rabbet body of said first sealing strip; and at least a second flexible element with opposing first and second ends that, within these first and second ends, extends at least between a first fixing device of said rabbet body of said second sealing strip and a second fixing device of said rabbet body of said second sealing strip, wherein said first and second fixing devices of said first and second sealing strips are present at or on said exterior side of said rabbet body of said respective first and second sealing strips, and wherein said first and second flexible elements when installed have a pre-stress.

* * * * *

UNITED STATES PATENT AND TRADEMARK OFFICE

CERTIFICATE OF CORRECTION

PATENT NO. : 7,487,808 B2
APPLICATION NO. : 11/750213
DATED : February 10, 2009
INVENTOR(S) : J. Stoye et al.

It is certified that error appears in the above-identified patent and that said Letters Patent is hereby corrected as shown below:

| COLUMN | LINE | ERROR |
|---|---|---|
| 24 (Claim 1, | 51 line 37) | "device said rabbet" should read --device of said rabbet-- |
| 25 (Claim 8, | 15 line 9) | "strip; and" should read --strip;-- |
| 25 (Claim 14, | 54 line 1) | delete "in accordance with" |
| 26 (Claim 16, | 2 line 6) | "projects" should read --project-- |
| 26 (Claim 21, | 35 line 3) | "apparatus spring." should read --apparatus.-- |
| 27 (Claim 27, | 1 line 15) | "or connectable" should read --or is connectable-- |
| 27 (Claim 27, | 4 line 18) | "or connectable" should read --or is connectable-- |
| 27 (Claim 30, | 21 line 3) | "**90**°" should read --90°-- |
| 27 (Claim 30, | 21 line 3) | "**240**°." should read --240°.-- |
| 27 (Claim 33, | 35 line 2) | "coffesponds" should read --corresponds-- |

Signed and Sealed this

Sixth Day of April, 2010

David J. Kappos

David J. Kappos
*Director of the United States Patent and Trademark Office*